US006213109B1

(12) United States Patent
Satoo et al.

(10) Patent No.: US 6,213,109 B1
(45) **Date of Patent: *Apr. 10, 2001**

(54) IGNITION COIL FOR USE IN INTERNAL COMBUSTION ENGINE

(75) Inventors: Takanori Satoo; Ryozo Takeuchi, both of Hitachi; Kazutoshi Kobayashi, Hitachinaka, all of (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/110,248

(22) Filed: Jul. 6, 1998

(30) Foreign Application Priority Data

Jul. 4, 1997 (JP) ..... 9-179288
Jul. 4, 1997 (JP) ..... 9-179303

(51) Int. Cl.[7] ..... F02P 11/00
(52) U.S. Cl. ..... 123/634; 336/107
(58) Field of Search ..... 123/634, 635, 123/647; 336/58, 107, 192, 96

(56) References Cited

U.S. PATENT DOCUMENTS 4,893,105 * 6/1990 Maeda et al. ..... 336/84 M
5,101,803 * 4/1992 Nakamura et al. ..... 123/634
5,714,922 * 2/1998 Suzuki et al. ..... 336/107
5,720,264 * 2/1998 Oosuka et al. ..... 123/634

FOREIGN PATENT DOCUMENTS 0 647 002 4/1995 (EP) .
0 703 588 3/1996 (EP) .
3-149805 6/1991 (JP) .

* cited by examiner

*Primary Examiner*—Henry C. Yuen
*Assistant Examiner*—Mahmoud M. Gimie
(74) *Attorney, Agent, or Firm*—Evenson, McKeown, Edwards & Lenahan, P.L.L.C.

(57) ABSTRACT

An ignition coil comprises a center magnetic core, a secondary coil wound on a secondary coil bobbin which is arranged at an outer side of said center magnetic core, a primary coil wound on a primary coil bobbin which is arranged at an outer side of said secondary coil. At least one of said secondary coil bobbin and said primary coil bobbin is formed by a material which contains sulfur in a main chain of an aromatic class. The ignition coil has a superior anti-electric treeing. A coil component of the secondary coil and the primary coil of the ignition coil is arranged and accommodated in a coil case, an epoxy resin filling up at least melting silica is potted and is hardened. A development of the electric treeing can be restrained and the ignition coil having a superior endurance performance can be provided.

3 Claims, 7 Drawing Sheets

IGNITION COIL FOR USE IN INTERNAL COMBUSTION ENGINE

BACKGROUND OF THE INVENTION

1. Technical Field

The present invention relates to an ignition coil for use in an internal combustion engine which is connected directly to an ignition plug and is accommodated in a plug hole of the internal combustion engine and further relates an internal combustion engine having such an ignition coil.

2. Prior Art

In a conventional ignition coil, as shown in Japanese patent laid-open publication No. Hei 3-149805, as a potting type resin which fixe and insulates the components such as a primary coil and a secondary coil etc. A thermoplastic resin comprised of an epoxy resin is used and further as a filling-up agent a crystalline silica is mainly employed.

In the conventional type ignition coil, since the ignition coil is accommodated in a plug hole having a diameter of 20–30 mm degree, a size in a radial direction of the coil is small and a distance between the primary coil and an outer side magnetic core is short. As a result, there is a case in which an insulation between the secondary coil having a high potential, the primary coil having a substantial ground potential and the outer side magnetic core can not be obtained. In particular, since a coil interior portion temperature is more than 150° C., there is an insulation endurance performance problem caused in a comparatively short time.

A technique to cope with the above problem a technique has known, namely such a technique is one (namely an inside secondary coil method), in which the primary coil having the substantial ground potential is arranged at an outer side magnetic core side and the secondary coil having the high potential is arranged at a center magnetic core side.

In this conventional technique, the center magnetic core presents a floating potential and a potential difference causes between the secondary coil having the high potential and the center magnetic core but since the potential difference is about half that of an outer side secondary coil system of an ignition coil in which a secondary coil is arranged at an outer side magnetic core, accordingly it has a merit that an insulation performance is superior.

However, as to the above stated inside secondary coil system ignition coil, in an operation endurance test in a heat cycle oven in which a drive mode of an actual vehicle is supposed, a breakdown between a secondary winding and an outer side magnetic core causes according to a heat shock, therefore there is a problem (a disturbance in a rotation of the engine) in the internal combustion engine. As a result of the study of this cause, it has become clear that since a thermal stress is concentrated at a vicinity of a crossover wire portion of a winding finish portion of the secondary coil, minute voids are generated in an insulation resin which is filled up at a neighborhood of the above stated winding crossover wire portion vicinity and an electric treeing generates at this portion according to the voids as a trigger and this electric treeing develops, as a result it is understood an insulation or dielectric breakdown in the ignition coil occurs.

SUMMARY OF THE INVENTION

An object of the present invention is to provide an ignition coil for use in an internal combustion engine wherein the ignition coil has a superior endurance performance against a heat cycle oven.

Another object of the present invention is to provide an ignition coil for use in an internal combustion engine wherein an electric tree hardly occurs and/or the electric tree hardly develops.

The above stated objects can be attained by a provision of a shielding member for restraining a development of an electric treeing even minute voids generate in an insulation resin, or at a portion for restraining the development of the electric treeing by a constitution of an insulation material in which the electric treeing hardly develop.

According to the present invention, since a high electric field portion in which the electric treeing generates easily is constituted by an insulation material in which sulfur (S) is put in an aromatic main chain and since an electric treeing shielding member comprised of the above stated material is arranged between a secondary coil and an outer side magnetic core, as a result a lowering in insulation performance due to the minute voids generation can be avoided and thus the heat cycle oven endurance performance can be improved.

Further the present invention can be attained by an ignition coil in which as a thermoplastic resin an epoxy resin in which melting silica powders are filled as a filling-up agent is potted.

The concrete constructions are as following.

(1) The thermoplastic potting type resin contains a filling-up agent in the resin, and at least part of the filling-up agent is formed by a melting silica, and the melting silica of 20 wt %–85 wt % is blended in a total filling-up agent amount.

In the above stated (1) item, in the ignition coil, said filling-up agent includes a mixture material comprised of said melting silica and a crystalline silica.

In the above stated (1) item, in the ignition coil, said secondary coil is arranged at a side of said center magnetic core, and said primary coil is arranged between said secondary coil and said outer side magnetic core.

In the above stated (1) item, in the ignition coil, said meting silica in said resin has a spherical shape.

(2) An internal combustion engine having an ignition coil comprises an ignition plug for igniting the engine, an ignition coil accommodated in a plug hole which is provided on an engine block to install said ignition plug and connected directly to said ignition plug, an igniter for controlling said ignition coil, and a potting type resin for fixing a primary coil, a secondary coil and a center magnetic core etc., said potting type resin containing a filling-up agent including a melting silica, and said melting silica in said resin containing 20 wt %–85 wt % in a total filling-up agent amount.

With the above stated construction, as the resin for fixing and insulating the components such as the primary coil and the secondary coil etc. of the ignition coil, by potting the thermoplastic resin in which the melting silica powders are filled up, since the occurrence and the development of the electric treeing under the high temperature is restrained, as a result an inconvenience in the insulation performance of the ignition coil can be reduced and the anti-endurance performance of the ignition coil can be heightened.

The particle diameter of the melting silica in the present invention is not limited in particularly but it is preferable to use the particle diameter having a range of 1–300 $\mu$m and preferably 5–44 $\mu$m. Further, it is preferable to use the spherical shape melting silica and the suitable effects can be expected. Further, as the melting silica and the crystalline silica of the present invention, fluorine system and silicone system coupling agent processing article can be used.

DESCRIPTION OF THE INVENTION

Figure 1:
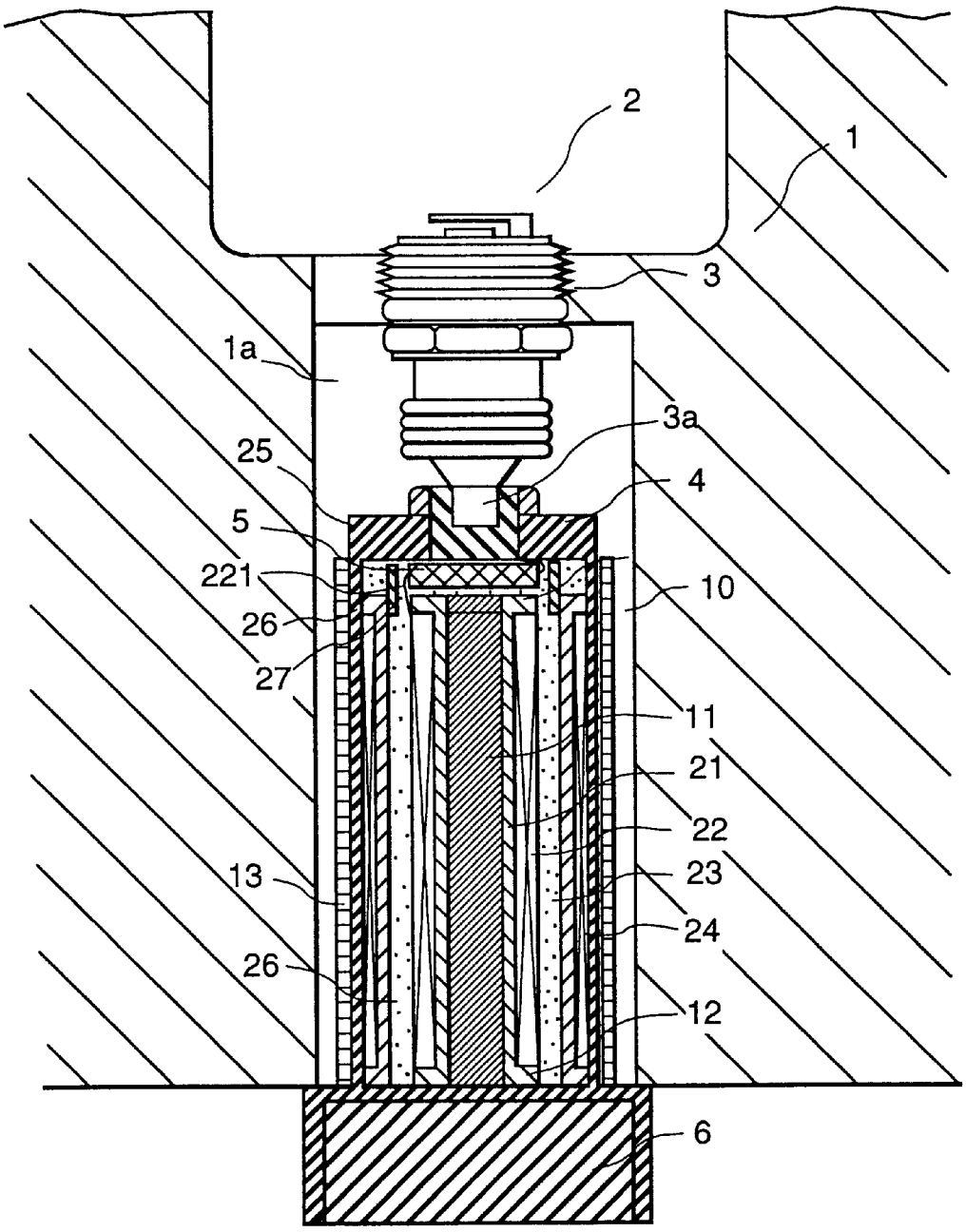
FIG. 1 is a cross-sectional view showing a first embodiment of an ignition coil according to the present invention.

Hereinafter, the embodiments of an ignition coil for use in an internal combustion engine for carrying out the present invention will be explained referring to the drawings. At first, a first embodiment of an ignition coil according to the present invention will be explained referring to FIG. 1 and FIG. 2.

FIG. 1 is a cross-sectional view showing a first embodiment of an ignition coil according to the present invention. Further, FIG. 1 is a cross-sectional view in which the ignition coil of the first embodiment is mounted in an interior portion of an internal combustion engine.

In FIG. 1, a cylindrical shape ignition coil 10 shown in the first embodiment is constituted by including a high voltage terminal 4, a high voltage diode 5, an igniter 6, a center magnetic core 11, a permanent magnet 12, an outer side magnetic core, a secondary coil bobbin 21 on which a secondary coil 22 is wound, a primary coil bobbin 23 on which a primary coil 24 is wound, a coil case 25, and an insulation resin 26.

The secondary coil 22 is wound on the secondary bobbin 21 comprised of a plastic molding article and the primary coil 24 is wound on the primary coil bobbin 23 comprised of a plastic molding article. The primary coil 24 is arranged at an outer side of the secondary coil 22 and further is arranged concentrically to the center magnetic core 11. An electric treeing shielding member 27 is arranged between a secondary coil crossover wire portion 221 at a high voltage side and a primary coil high voltage side 24.

Each of the components comprised of the center magnetic core 11, the secondary coil bobbin 21, the secondary coil 22, the primary coil bobbin 23, and the primary coil 24 etc. is accommodated in the cylindrical shape coil case 25 and, for example, is filled up and fixed by an insulation resin 26 in which melting silica powders are filled up to an insulation material comprised of an epoxy resin.

An outer side magnetic core 13 is arranged at a periphery of the coil case 25 and then the ignition coil 10 is constituted. Further, the secondary voltage generated from the secondary coil 22 passes the secondary crossover wire portion 221 and a high voltage diode lead wire 51 and is led to the high voltage diode 5 and the high voltage terminal 4. Further, the igniter 6 is comprised of a power transistor and a diode etc.

On the other hand, a constrution where the ignition coil 10 is installed to the plug hole of the engine is shown in FIG. 1. In FIG. 1, reference numeral 1 denotes an engine block of the internal combustion engine, 2 denotes a combustion chamber which is formed in the engine block 1, 3 denotes an ignition plug which is inserted and fixed to a plug hole 1*a* of the engine block 1, 3*a* denotes an electrode of the ignition plug 3, this electrode 3*a* is adhered and connected electrically to the high voltage terminal 4 of the ignition coil 10.

Figure 2:
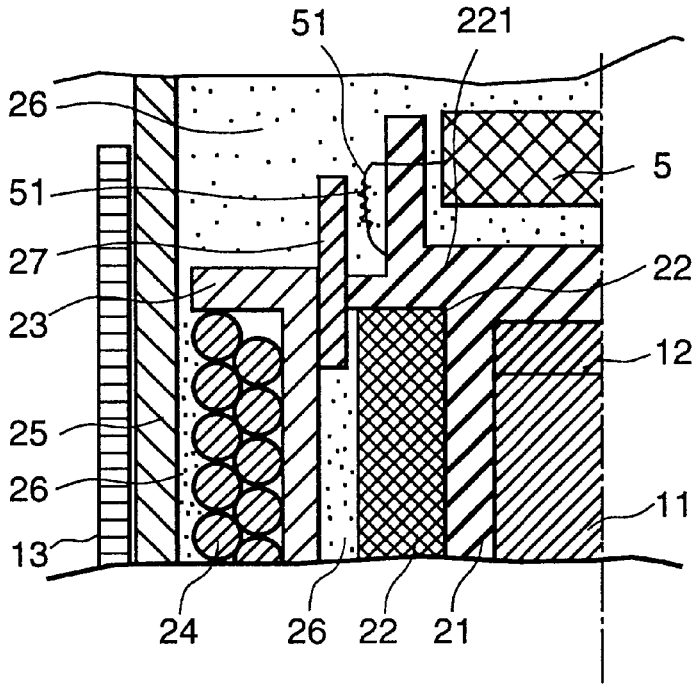
FIG. 2 is a partially cross-sectional view showing the ignition coil of FIG. 1.

FIG. 2 is a partially cross-sectional view showing the ignition coil 10 of FIG. 1 and shows an essential portion construction of vicinity of a high voltage diode lead wire portion 51. In FIG. 2, the electric treeing shielding member 27 is provided at an outer periphery of the secondary coil crossover wire portion 221 and is arranged under a lapping condition to the primary coil bobbin 23.

The electric treeing shielding member 27 in this embodiment is an insulation material in which PPS (polyfenylene sulfide) resin is molded with a cylindrical shape and is arranged at a predetermined position during a coil assembling time after a winding.

In the ignition coil having the above stated construction, during the magnetic field generation due to the primary coil 24, by cutting off the current flowing to the primary coil 24, the high voltage of about 30 kV generates to the secondary coil 22. This high voltage is supplied to the ignition plug 3 which is connected directly to the high voltage terminal 4. And the high voltage due to the above stated primary coil 24 is applied to between the secondary coil 22 and the primary coil 24 and between the secondary coil 22 and the outer side magnetic core 13.

On the other hand, at a vicinity of a high voltage side end portion of the secondary coil 22, since in addition to a complicated shape secondary coil bobbin 21 and the components having the complicated shapes such as the high diode 5 etc. are arranged, according to the concentration of the thermal stress the minute voids is easily to cause in the insulation resin 26 which is positioned at the above stated vicinity.

In this case, when the above stated minute voids are caused on the insulation resin 26 which is arranged at the secondary coil crossover wire portion 221, since this portion presents the high electric field and further a conductive wire diameter is small, as a result the electric tree is easily to caused.

This electric tree has a property which develops toward an electric field direction (a direction for the primary coil 24, the outer side magnetic core 13 and the center magnetic core 11). As a result, the development of the electric tree can be prevented by a constitution by a member in which an insulation constituting member (for example, the secondary coil bobbin 21, the primary coil bobbin 23, the coil case 25) in this high electric field portion or by arranging an electric tree shielding member 27 which comprises the above stated material.

Further, the above stated insulation constituting member for restraining the electric tree, the material of the electric tree shielding member 27 and a material of the potting type resin 26 will be explained in a latter portion.

As shown in the above stated embodiment, as the periphery insulation constituting member of the secondary coil crossover wire portion 221, since the insulation member for preventing the development of the electric tree is constituted and the electric tree shielding member 27 is arranged, at the vicinity of the secondary coil crossover wire portion 221 which presents the high electric field, in a case where the minute voids generate according to the thermal stress and the electric tree occurs by the minute voids as a trigger, since the insulation constituting member having a function for preventing the development of the electric tree toward the electric field is intervened or the electric tree shielding member 27 is arranged, as a result the development of the electric tree can be restrained and the breakdown can be prevented.

Therefore, in the internal combustion engine in which the ignition coil according to the present invention is inserted to the plug hole as shown in FIG. 1, under a condition of the severe heat cycle oven in the plug hole, since the breakdown of the ignition coil hardly generate, as a result a reliability of the engine can be improved.

Figure 3:
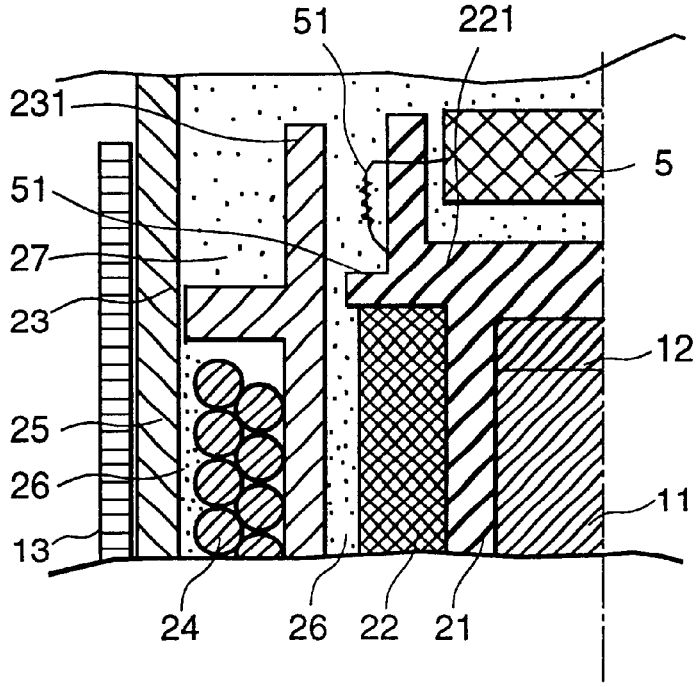
FIG. 3 is a partially cross-sectional view showing a second embodiment of an ignition coil according to the present invention.

FIG. 3 is a partially cross-sectional view showing a second embodiment of an ignition coil according to the present invention and shows an essential portion constitution of the ignition coil 10 similarly to FIG. 2.

In this second embodiment, in place of the arrangement of the electric treeing shield member 27 of FIG. 2, as an electric treeing shielding member toward the outer side magnetic core 14 of the secondary coil crossover wire portion 221, a bobbin end portion 231 of the primary coil bobbin 23 is extended long toward a high voltage diode side. The bobbin material of the primary coil bobbin 23 in this case is constituted an insulation member comprised of PPS (polyfenylene sulfide) resin member similarly to the above stated treeing shielding member 27.

With this constitution, even the minute voids generate at the vicinity of the secondary coil crossover wire portion 221, since the development the electric treeing caused by the minute voids is restrained by the primary coil bobbin end portion 231 which is arranged toward the electric field and further since the development toward the cracks is restrained, as a result the breakdown of the ignition coil 10 can be prevented.

Figure 4:
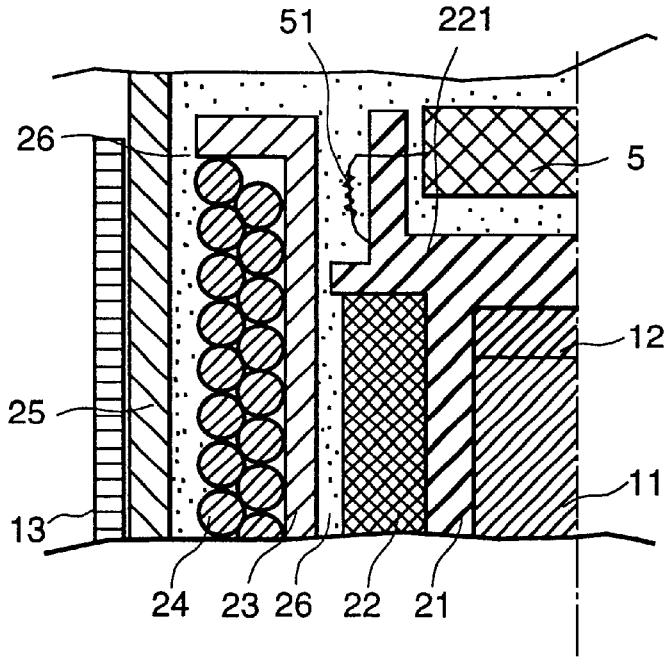
FIG. 4 is a partially cross-sectional view showing a third embodiment of an ignition coil according to the present invention.

FIG. 4 is a partially cross-sectional view showing an ignition coil of a third embodiment according to the present invention and shows an essential portion constitution of the ignition coil 10 similarly to FIG. 2.

In this third embodiment, in place of the constitution in which the bobbin end portion 231 of the primary coil bobbin 23 is extended long in the second embodiment of FIG. 3, a high voltage side of the primary coil bobbin 23 is arranged at the high voltage diode side to cover the secondary coil crossover wire portion 221. This third embodiment can be expected the effects similarly to the above stated second embodiment.

Next, an endurance test result of the ignition coil of the embodiments according to the present invention will be explained.

Figure 5:
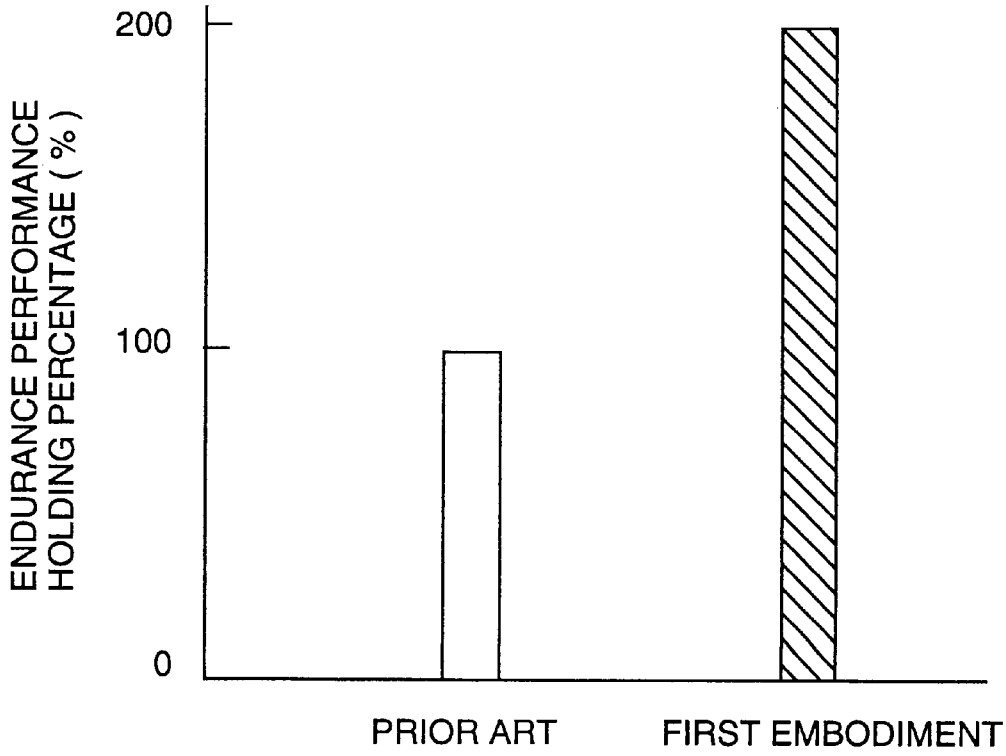
FIG. 5 is a view showing a test result of an endurance performance of the ignition coil of the first embodiment.
Figure 6:
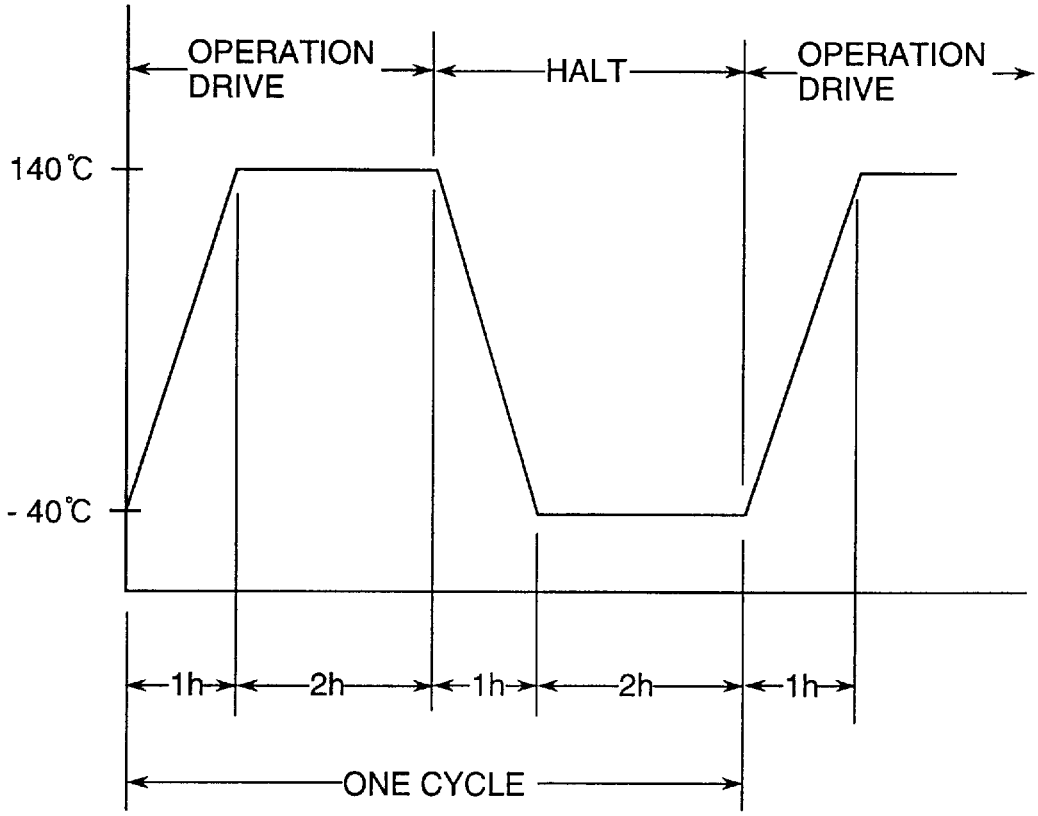
FIG. 6 is a view showing a test condition of the endurance performance of FIG. 5.

FIG. 5 is a view showing under a test condition shown in FIG. 6 and operating the ignition coil at only high temperature (the surrounding temperature 140° C.) the endurance life until the generation of the insulation destroy is compared and this figure shows an endurance performance of the ignition coil of the first embodiment. From a result shown in FIG. 5, it can be understood that the endurance performance of the ignition coil according to the present invention is improved with about 2.5 times compared with the prior art ignition coil.

Next, a relationship between the materials for the electric treeing shielding member 27, the primary coil bobbin, the secondary coil bobbin and the coil case and the insulation life will be explained.

Figure 7:
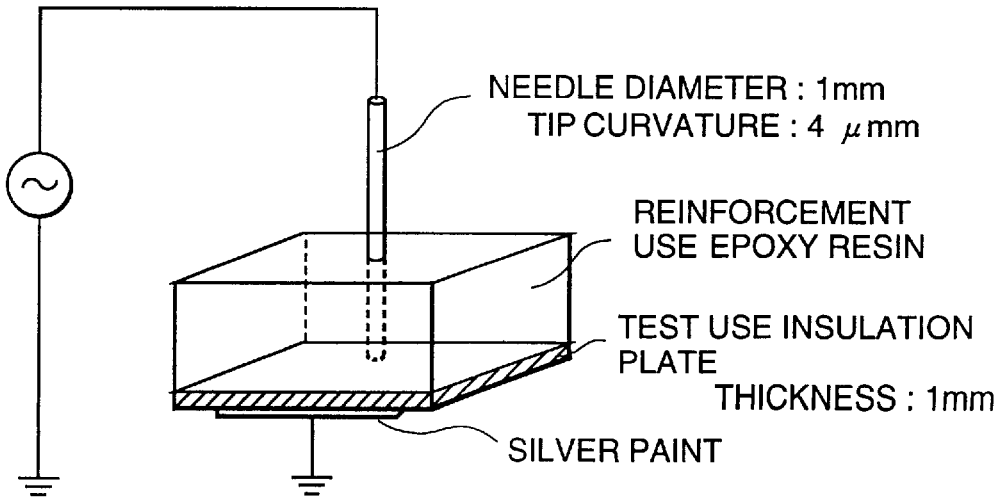
FIG. 7 is a view showing an electric treeing life test result of an electric treeing shield member.
Figure 8:
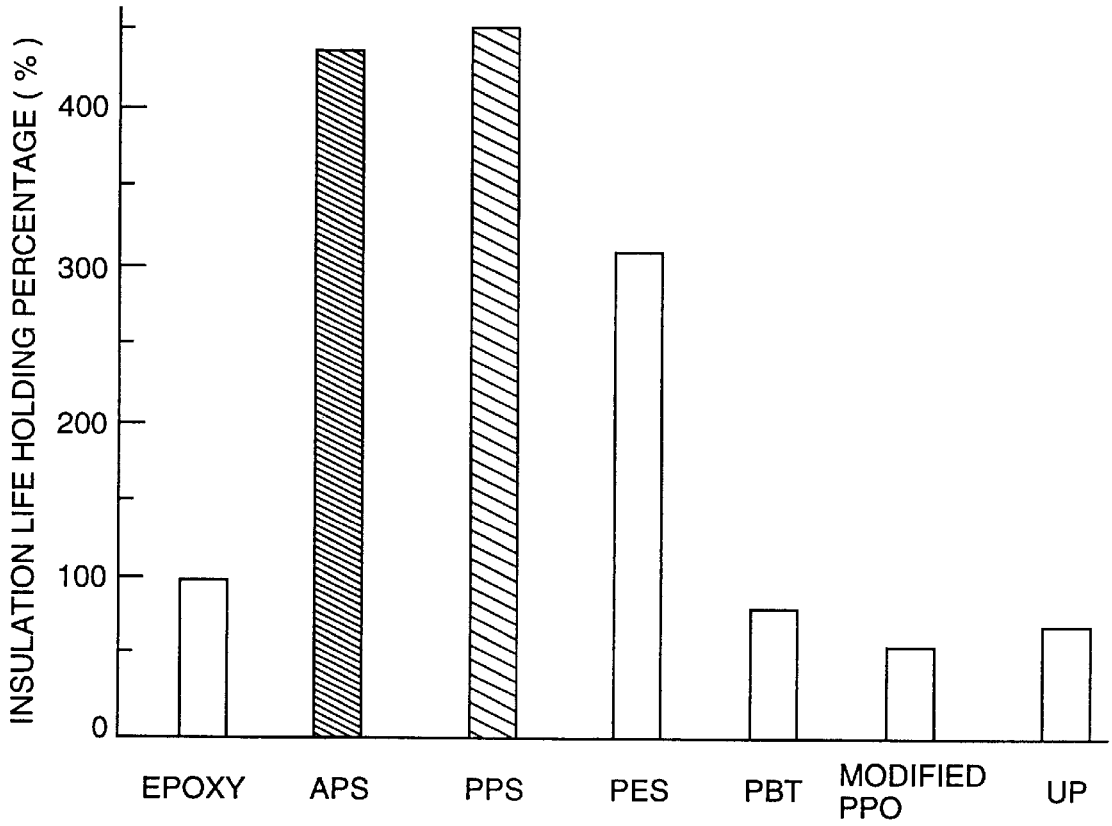
FIG. 8 is a view showing an electric treeing life test method of FIG. 7.

FIG. 7 shows in the first embodiment shown in FIG. 2 as the insulation materials of the electric treeing shielding member 27, each case in which the resin is (1) PPS (polyfenylene sulfide), (2) PBT (polybuthlene terephthalate), (3) a modified PPO (a modified polyfenylene oxide), (4) PES (polyether sulfone), (5) m UP (unsaturated polyester), (6) epoxy, and (7) APS (a blending article of PPS and PPO), by preparing an electric treeing life test use sample in which a needle electrode shown in FIG. 8 is inserted and the electric treeing test was carried out under the high temperature (150° C.) atmosphere.

This electric treeing life test method is authorized by the Electrics Association and an anti-electric treeing performance is indicated by a life time until the generation of the insulation destroy. A filling-up agent of each of the resins of the sample is that only the epoxy in (6) silica powders (40 vol % filling-up) are used and in the others glass short fibbers (30 vol % filling-up).

Figure 9:
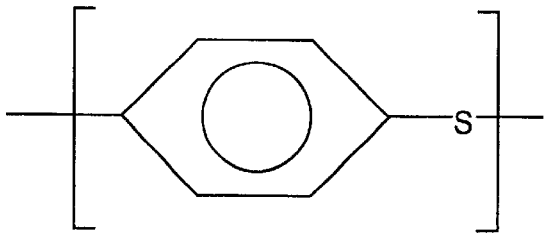
FIG. 9 is a view showing a chemical formula of the electric treeing shielding member.

From those results, it can be understood that the articles using PPS in (1) and APS in (7) have a comparative long life and rank next to PES in (4). It is not clear a reason that the articles using PPS and APS have a superior characteristic, it is considered that the partial discharge inferior can be restrained by a fact in which a very small quantity sulfur (S) is added to the epoxy resin material. As shown in a chemical formula of those PPS and APS of FIG. 9, an aromatic polymer having a sulfur atom is included in a main chine of the chemical molecular structure. Accordingly, it is considered that the aromatic polymer retrains the development of the electric treeing.

Figure 10:
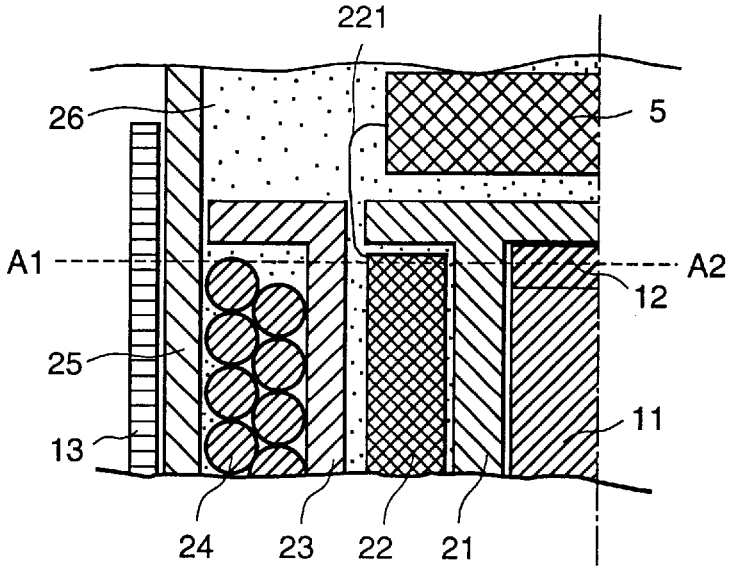
FIG. 10 is a partial enlargement view for explaining a fourth embodiment of an ignition coil according to the present invention.

FIG. 10 is a view showing an essential portion construction of the ignition coil 10 according to the fourth embodiment and is an ignition coil longitudinal cross-sectional view at the vicinity of the high voltage diode 5. A fixing for the components of the secondary coil bobbin 21, the secondary coil 22, the primary coil bobbin 23, the primary coil 4 and the above stated high voltage diode 5 etc. in the coil case 13 and an electric insulation between those components are carried out using a potting type resin 26 comprised of an epoxy resin in which a melting silica is filled up.

In the ignition coil having the above stated construction, during the magnetic field generation due to the primary coil 24, by cutting off the current flowing the primary coil 24 the high voltage about 30 kV generates to the secondary coil 22. This high voltage is supplied to the ignition plug 3 which is connected directly to the high voltage terminal 4.

The high voltage generated by the secondary coil 22 is applied to between the secondary coil 22 and the primary coil 24 and the center magnetic core 11. Among them, as to a portion (a lower portion from a line A1–A2 in FIG. 10) corresponding to the secondary coil 22 of the secondary coil bobbin 21, since each of the primary coil 24 and the outside magnetic core 14 is formed with a cylindrical shape against the secondary coil 22, since the electric field at the above stated portion has an electric field near to an uniform electric field, an inconvenience about the insulation hardly comparatively occurs.

On the other hand, at a portion which is positioned an upper portion from the line A1–A2 in FIG. 10, the secondary crossover wire portion 221 of the secondary coil bobbin 21 is slipped off the above stated concentrically cylindrical shape appearance, the large electric field concentration occurs at this portion. In the above stated electric field concentration portion, the potting type resin 26 is employed, such a resin is comprised of the melting silica and the crystalline silica (the blending ratio (weight) of the former and the latter is 60/40) of 50 wt % are filled up.

A composition and a hardening condition of the above stated potting type resin 26 according to this embodiment are shown in Table 1 and the physical properties example of the melting silica is shown in Table 2.

TABLE 1

Main composition and hardening condition of potting type resin according to the fourth embodiment

| | | |
|---|---|---|
| bisphenole A type epoxy resin | | 27 wt % |
| acid anhydride hardeninq agent | | 23 wt % |
| filing-up agent | crystalline silica | 20 wt % |
| | melting silica | 30 wt % |
| hardening condition: 100° C.; 2 hours + 135° C.; 2 hours | | |

TABLE 2

Main physical properties of melting silica used in the Fourth embodiment

| | |
|---|---|
| gravity | 2.2 |
| specific heat | 0.2 kcal/kg °C. |
| thermal conductivity | 1.4 W/m °C. |
| linear expansion rate | $0.5 \times 10^{-6}$ deg$^{-1}$ |
| dielectric constant | 3.5 |

As shown in the above stated embodiment, at the vicinity of the secondary coil crossover wire 221 of the secondary coil bobbin 21 where the electric field concentration becomes large remarkably, by the existence of the potting type resin 25 comprised of the epoxy rein in which the melting silica filled up, the minute crack hardly occur even at the low temperature and further the generation and the development of the electric treeing which leads the insulation destroy under the high temperature can be restrained, as a result, the insulation endurance performance of the ignition coil can be heightened.

As to the ignition coil in this embodiment similarly to the ignition coil of the other embodiments, according to the operation endurance test in the heat cycle oven shown in FIG. 6 the endurance life of the ignition coil according to this embodiment with the prior art ignition coil has compared and as a result the effects similarly to those of FIG. 5 can be obtained. In this case, in the prior art, an amorphous crystalline silica as the filling-up agent of 55 wt % was filled up to the potting type resin 26. The anti-insulation endurance performance of the ignition coil according to the present invention can be improved about 1.7 times compared with that of the prior art.

Figure 11:
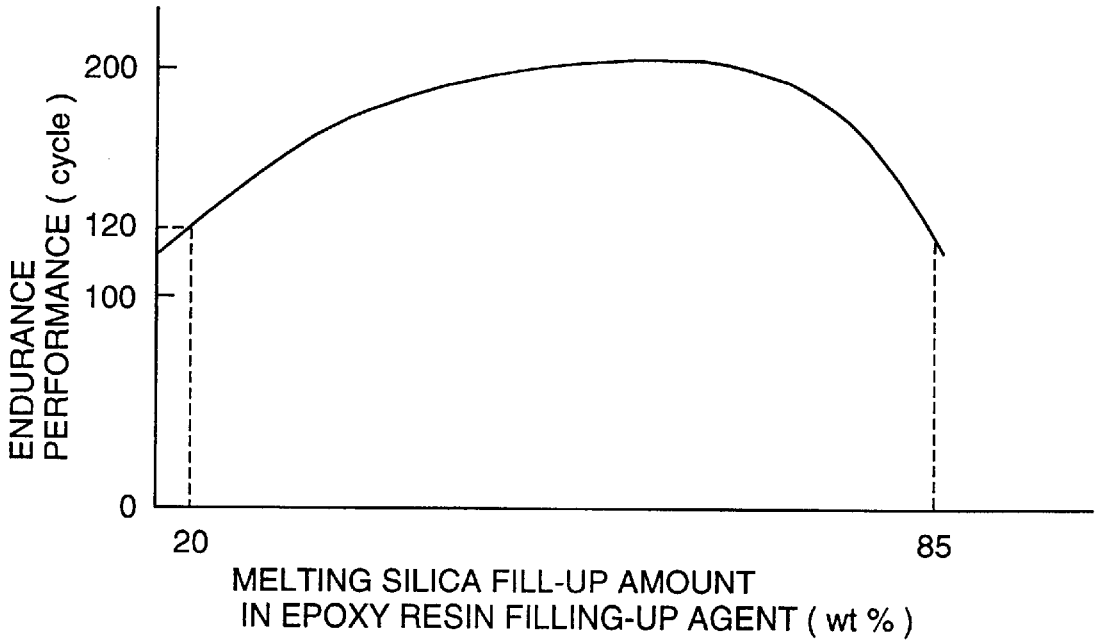
FIG. 11 is a graph for explaining effects of the fourth embodiment of the ignition coil according to the present invention.

FIG. 11 is a graph showing a relationship between the filling-up amount of the melting silica in the filling-up agent and the insulation endurance in a case where the melting silica and the crystalline silica are filled up to the potting type resin 26.

In a case where the filling-up amount of the filling-up agent in the potting type resin 26 is from 30 wt % to 75 wt %, when the filling-up amount of the melting silica in the filling-up agent is less than about 20 wt %, the restraint effect of the above stated electric treeing is small and at more than about 85 wt % the thermal conductivity of the potting type resin 26 lowers and the temperature arise at the vicinity of a secondary coil conductor becomes large, as a result the development of the electric treeing is easily to carry out and further an inconvenience in the insulation endurance is easily to cause.

Figure 12:
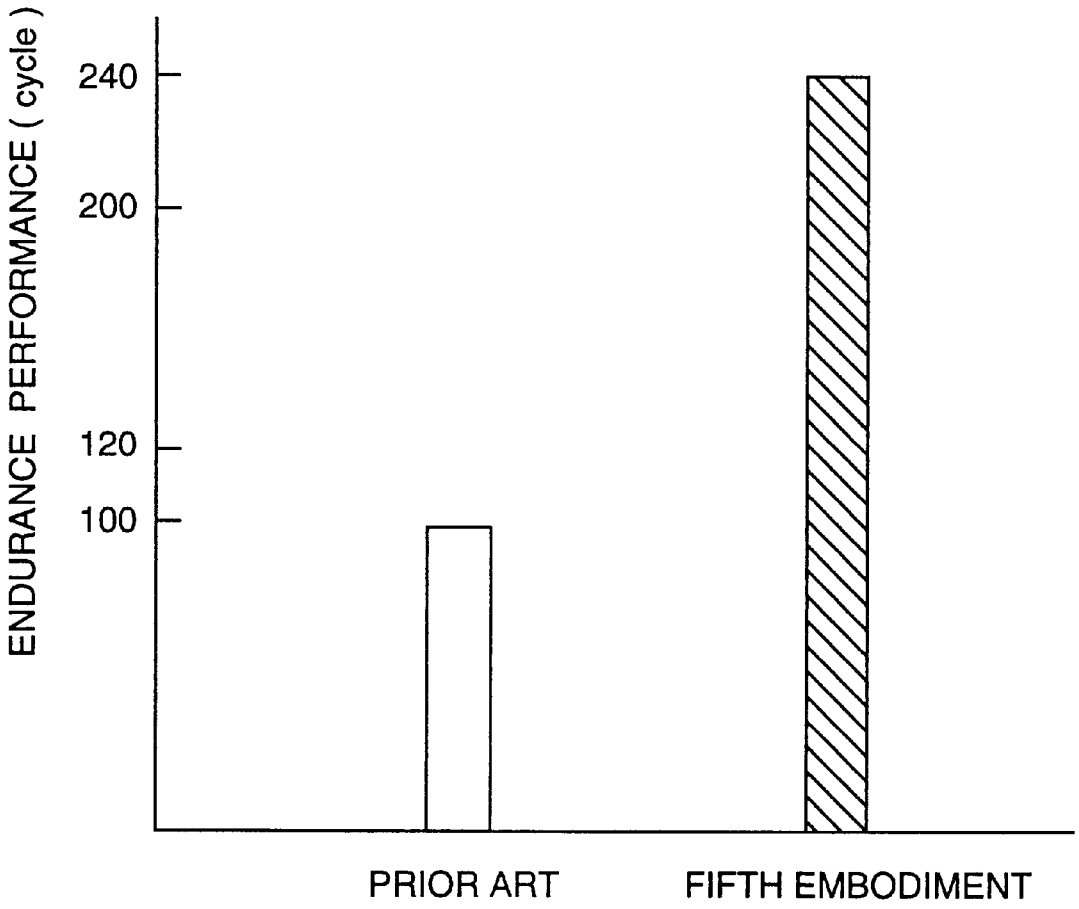
FIG. 12 is a graph for explaining effects of a fifth embodiment of the ignition coil according to the present invention.

FIG. 12 is a graph for explaining the effects of a fifth embodiment according to the present invention. The endurance life of a spherical shape melting silica (except for the spherical shape, the physical properties are same shown in Table 1) in which the same amount shown in the fourth embodiment is filled up as the filling-up agent to the potting type rein 26 was compared with that of the prior art. In this case, since the figure of the filling-up agent is spherical, the minute cracks hardly cause further and the insulation endurance can be heightened further.

Further, as the coil construction, in the ignition coil in which the primary coil is arranged at the center magnetic core 11 side and the secondary coil is arranged at the outer side magnetic core side, in a case where the epoxy resin containing the melting silica of the above stated embodiment is potted as the potting type resin 26, at the vicinity of the secondary coil crossover wire portion 221 of the secondary coil bobbin 21 in which the electric field concentration becomes large remarkably, by the existence of the constitution in which the potting resin 26 comprised of the epoxy resin in which the melting silica is filled up, similarly to the above stated embodiments the occurrence and the development of the electric treeing can be restrained, as a result the insulation endurance performance of the ignition coil can be heightened.

Further, in the above stated embodiment, as the epoxy resin for filling up the melting silica bisphenol A type is used and as the hardening agent acid anhydride is used, however the present invention is not to limited to the above stated epoxy resin type but in another type (for example, as an epoxy resin novolak type and as a hardening agent amine class) the similar effects can be obtained.

Further, when the first—the third embodiments are combined with the fourth and the fifth embodiments, the ignition coil having further high insulation endurance performance can be obtained.

According to the present invention, at the vicinity of the secondary coil crossover wire portion in which the secondary coil and the high voltage lead wire are connected electrically, according to the constitution in which the member comprised of the material having the function for preventing the development of the electric treeing or according to the arrangement of the electric treeing shielding member 27 comprised of the above stated material, since the development of the electric treeing can be restrained, as a result the ignition coil having the superior endurance performance can be provided.

Further, according to the present invention, since the coil components such as the primary coil and the secondary coil etc. is fixed using the potting type resin in which a predetermined melting silica is filled up to the epoxy resin and in particularly the secondary coil crossover wire portion is insulated, since the occurrence and the development of the electric treeing under the high temperature atmosphere can be restrained, as a result the ignition coil having the superior insulation endurance performance and the internal combustion engine having the ignition coil can be provided.

What is claimed is:

1. An ignition coil for use in an internal combustion engine comprising a center magnetic core, a secondary coil wound on a secondary coil bobbin which is arranged at an outer side of said center magnetic core, a primary coil wound on a primary coil bobbin which is arranged at an outer side of said secondary coil, whereby a high voltage output is generated by interrupting the current flowing through said primary coil to ignite an air-fuel mixture in a cylinder of the engine, and a shielding member for enclosing a crossover wire portion of said secondary coil between said secondary coil bobbin and said primary coil bobbin.

2. An ignition coil for use in an internal combustion engine, comprising a primary coil bobbin of a primary coil enclosed in a periphery of a crossover wire portion of a secondary coil bobbin of a secondary coil, wherein the crossover wire portion passing through an outer periphery of the secondary coil bobbin and extending to a side of the ignition coil, and the primary coil and secondary coil and their associated bobbins are filled up in a case and buried in a solidified potting resin.

3. An ignition coil for use in an internal combustion engine according to claim 2, wherein at least one of said secondary coil bobbin and said primary coil bobbin is comprised of a polyphenylene sulfide (PPS) resin.

* * * * *